US010323424B2

(12) United States Patent
Young

(10) Patent No.: US 10,323,424 B2
(45) Date of Patent: Jun. 18, 2019

(54) CONCRETE FORM SYSTEM WITH RESILIENT BRACKETS SECURING FORM BOARDS TO STAKES

(71) Applicant: Norman D. Young, Springville, UT (US)

(72) Inventor: Norman D. Young, Springville, UT (US)

( * ) Notice: Subject to any disclaimer, the term of this patent is extended or adjusted under 35 U.S.C. 154(b) by 0 days.

(21) Appl. No.: 16/044,923

(22) Filed: Jul. 25, 2018

(65) Prior Publication Data

US 2019/0032347 A1 Jan. 31, 2019

Related U.S. Application Data

(60) Provisional application No. 62/536,695, filed on Jul. 25, 2017.

(51) Int. Cl.
*E04G 17/14* (2006.01)
*E04G 9/00* (2006.01)
*E04G 17/00* (2006.01)

(52) U.S. Cl.
CPC ..... *E04G 17/14* (2013.01); *E04G 9/00* (2013.01); *E04G 17/001* (2013.01); *Y10T 24/44923* (2015.01)

(58) Field of Classification Search
CPC ..... E04G 17/14; E04G 9/00; Y10T 24/44769; Y10T 24/44778
USPC ..... 249/3, 4, 6, 7; 24/545, 546; 403/397
See application file for complete search history.

(56) References Cited

U.S. PATENT DOCUMENTS 977,704 A * 12/1910 Brownlee ..... E04C 5/167 24/457
1,063,663 A * 6/1913 Davis ..... E04C 5/168 52/686
1,329,177 A 1/1920 Heltzel
1,496,933 A * 6/1924 Heltzel ..... E01C 19/506 249/189
1,756,514 A 4/1930 Hempstead
1,939,007 A 1/1931 Heltzel
1,986,528 A * 1/1935 Ranger ..... E04C 5/166 403/400
1,988,900 A 1/1935 Heltzel
2,216,886 A * 10/1940 Langelier ..... B01L 9/50 126/30
2,446,255 A 8/1948 Vocisano
2,635,320 A 4/1953 Ornitz
2,663,925 A 12/1953 Yates
2,795,834 A * 6/1957 Szoke ..... A47G 29/08 248/113

(Continued)

*Primary Examiner* — Michael Safavi
(74) *Attorney, Agent, or Firm* — Morriss O'Bryant Compagni Cannon, PLLC

(57) ABSTRACT

A concrete form system includes a plurality of concrete form board brackets. The plurality of brackets includes brackets for securing the concrete form board to a conventional type metal or wood concrete form stake without the need for nails. The plurality of brackets also includes concrete form board end brackets for securing the ends of adjacent concrete form boards together that allows for a range of angles to be formed between two adjacent concrete form boards from zero degrees to more than 180 degrees. The present invention also includes flexible sections of concrete forms configured to be coupled to the brackets that allow for forming curved concrete edges.

28 Claims, 13 Drawing Sheets

(56) References Cited

U.S. PATENT DOCUMENTS 2,846,749 A 8/1958 Yates et al.
2,923,385 A * 2/1960 Tinnerman ..... F16B 2/20 24/326
3,055,686 A * 9/1962 Havener ..... E04B 1/5818 403/387
3,120,687 A * 2/1964 Greening ..... A44B 9/00 24/351
3,154,276 A * 10/1964 Havener ..... F16B 2/246 24/339
3,378,968 A 10/1965 Shoemaker
3,239,902 A * 3/1966 Cohen ..... A47F 7/16 223/91
3,295,812 A * 1/1967 Schneider ..... F16B 2/246 24/329
3,333,380 A 8/1967 Wolf
3,378,973 A * 4/1968 Tudor-Pole ..... E04F 19/02 52/287.1
3,503,193 A * 3/1970 Reynolds ..... A01D 43/063 56/202
3,579,938 A 5/1971 Hanson
3,594,692 A * 7/1971 Oakes ..... H01R 31/06 439/268
3,638,894 A * 2/1972 Leutenegger ..... F16B 2/246 211/110
3,680,823 A 8/1972 Lougheed
3,752,902 A * 8/1973 Wilson ..... H01B 17/145 174/163 F
3,784,313 A 1/1974 Collier, Jr.
3,785,606 A 1/1974 Green
4,066,237 A 1/1978 Bentz
4,168,423 A * 9/1979 Gilreath ..... F24C 7/06 219/402
4,232,847 A * 11/1980 Cooper ..... E04G 21/10 248/218.4
4,309,120 A * 1/1982 Werthmann ..... F16B 2/246 16/DIG. 25
4,340,200 A * 7/1982 Stegmeier ..... E04G 13/00 249/168
4,455,104 A 6/1984 Weisbach
D311,126 S * 10/1990 Crowley ..... D8/354
5,035,384 A * 7/1991 Werthmann ..... E01C 19/008 24/339
5,311,646 A * 5/1994 Eischen, Sr. ..... B65D 33/1625 24/30.5 R
5,419,055 A 5/1995 Meadows
5,533,239 A * 7/1996 Gall ..... E04C 5/08 24/129 B
5,598,682 A * 2/1997 Haughian ..... E04C 5/163 52/745.21
6,367,764 B1 4/2002 Butler
6,536,737 B1 * 3/2003 Davis ..... E04G 13/00 249/210
6,966,353 B2 * 11/2005 Hsu ..... E06B 9/38 160/168.1 R
7,229,062 B1 * 6/2007 Rascon ..... E04G 13/00 249/218
7,878,469 B2 2/2011 Hasenoehrl et al.
9,115,533 B2 * 8/2015 Ng ..... E06B 9/42
2004/0094689 A1 * 5/2004 Rose ..... E04G 13/02 249/6
2008/0118308 A1 5/2008 Jones
2008/0265127 A1 10/2008 Sladojevic et al.
2009/0272873 A1 11/2009 Fittler et al.

* cited by examiner

CONCRETE FORM SYSTEM WITH RESILIENT BRACKETS SECURING FORM BOARDS TO STAKES

CROSS-REFERENCE TO RELATED APPLICATION

This application claims priority to U.S. Provisional Patent Application No. 62/536,695 filed on Jul. 25, 2017, the entirety of which is incorporated by this reference.

BACKGROUND

Field of the Invention

The present invention relates generally to devices for forming concrete forms for pouring concrete slabs and the like. More particularly, it relates to a concrete form system that includes a plurality of brackets for supporting concrete forms.

Description of the Related Art

A typical prior art concrete form system uses wooden or metal stakes attached by nails to wooden boards (such as 2×4 or 2×6 planks) that are used as forms. A typical prior art concrete form system consists of a plurality of stakes inserted vertically into the ground and flush against a concrete form board so as to abut the concrete form board.

Once the concrete form board is properly positioned, nails are used to secure the stakes to the concrete form board. When using metal stakes, such stakes are provided with one or more transverse holes that extend through the stake so that nails can be inserted through the holes and driven into the concrete form board, thereby securing the concrete form board to the stakes.

Once the stakes are nailed to the concrete form board, it is difficult to vertically adjust the concrete form boards without removing the nails that secure the stakes to the concrete form boards. That is, in a typical prior art concrete form system, the nails that are holding the stakes to the concrete form board must be removed before the concrete form board can be raised or lowered relative to the stake. Also, depending on the vertical distance the concrete form board needs to be moved, the stakes may need to be removed from the ground, after which the stakes must be driven back into the ground at another location or height and reattached to the concrete form board with nails.

When using typical prior art metal stakes containing nail holes as previously discussed, it is often the case that such holes become filled with hardened concrete that makes subsequent use of such metal stakes difficult or impossible without first taking time to remove the hardened concrete. In addition, when using wood stakes, such stakes have a limited number of times they can have nails driven into them before they split. Also, the cost of nails, which can typically only used once, becomes expensive over time.

Thus, there exists a need in the art to provide a concrete form system that allows for easy vertical adjustment of the concrete form board once attached to a stake, that is reusable and does not require the use of nails to secure the concrete form board to the stake.

SUMMARY OF THE INVENTION

The present invention provides a concrete form system comprising a plurality of concrete form board brackets. The plurality of brackets includes brackets for securing the concrete form board to a conventional type metal or wood concrete form stake without the need of nails. The plurality of brackets also includes concrete form board end brackets for securing the ends of adjacent concrete form boards together that allows for a range of angles to be formed between two adjacent concrete form boards from nearly zero degrees to 180 degrees. The present invention also includes flexible sections of concrete forms configured to be coupled to the brackets that allow for forming curved concrete edges.

The brackets for securing the concrete form boards to stakes are generally C-shaped brackets configured to wrap around three sides of a concrete form board and include recesses for securing the brackets to the stakes. Once attached, the brackets bias the concrete form board against the stake to securely hold it in place.

The brackets for securing adjacent board ends together are provided with interlocking features that allow two identical adjacent brackets to interlock and pivot relative to one another.

The flexible section of concrete forms are formed from thin strips that are provided with laterally extending tabs that can be received within holes in the brackets to secure the flexible concrete forms to the brackets using the C-shaped brackets previously discussed.

In one embodiment of the concrete form system in accordance with the present invention includes a plurality of concrete form board retaining brackets, a plurality of concrete form stakes and at least one concrete form board. Each of the plurality of concrete form board retaining brackets are configured to retain the at least one concrete form board to a respective on of the plurality of concrete form stakes. Each concrete form board retaining bracket has an upper and lower stake retaining portion that bias the respective concrete form stake against an outer surface of the at least one concrete form board. The upper and lower stake retaining portions each defining a recess that engages an outer surface of the concrete form stake to hold the stake relative to the bracket.

In another embodiment, the plurality of concrete form board retaining brackets comprise a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction.

In another embodiment, a distance between the first wall and the second wall at the back wall is configured to be approximately equal to a width of a concrete form board when the concrete form board is abutted against the front side of the back wall.

In still another embodiment, the upper wall extends upwardly and away from a top surface of the concrete form board when in a resting position of the concrete form bracket and wherein the lower wall extends downwardly and away from a bottom surface of the concrete form board when in the resting position.

In yet another embodiment, the upper stake retaining portion is comprised of a first recess having a first stake receiving opening along a portion of a first side of the upper wall and a first stake retaining portion configured to retain a first portion of an elongate concrete form stake therein. Likewise, the lower stake retaining portion is comprised of a second recess having a second stake receiving opening along a portion of a first side of the upper wall and a second stake retaining portion configured to retain a second portion of the elongate concrete form stake therein when the respective one of the plurality of concrete form stakes extends through the first recess and the second recess.

The upper wall and lower wall are compressible toward one another when the upper wall is forced toward the lower wall and the back wall is abutting against a concrete form board positioned between the upper wall and lower wall to allow the respective one of the plurality of concrete form stakes to be positioned between the at least one concrete form board and outermost edges of the upper and lower stake retaining portions. The upper and lower stake retaining portions are biased away from one another to hold the respective one of the plurality of concrete form stakes against a surface of the concrete form board.

In one embodiment, the concrete form system comprises at least one pair of concrete form board end joining brackets, each configured to extend over a respective end of adjacent concrete form boards and interlock in a hermaphroditic manner.

The concrete form board end joining brackets form a hinge to allow the adjacent concrete form boards to pivot relative to one another until held in position with the plurality of concrete form retaining brackets.

Each concrete form board end joining bracket wrap at least partially around the respective end of the concrete form board and comprise a stop positioned adjacent the respective end of the concrete form board to position the respective concrete form board relative to the respective concrete form board end joining bracket.

In another embodiment, the concrete form board is comprised of a curved form coupled to and between the plurality of concrete form board retaining brackets.

In yet another embodiment, the back wall of the concrete form board retaining bracket defines an aperture and the concrete form board comprises a bracket retaining member extending therefrom. The bracket retaining member is received within the aperture to position the at least one concrete form board relative to the concrete form board retaining bracket.

In still another embodiment, the upper wall, lower wall and back wall of each of the plurality of concrete form brackets are each inwardly curved in a resting position.

BRIEF DESCRIPTION OF THE DRAWINGS

The following detailed description of the illustrated embodiments is better understood when read in conjunction with the appended drawings. For the purpose of illustrating the invention, there is shown in the drawings exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. Thus, the full scope of the invention is not limited to the examples that are described below.

Figure 1:
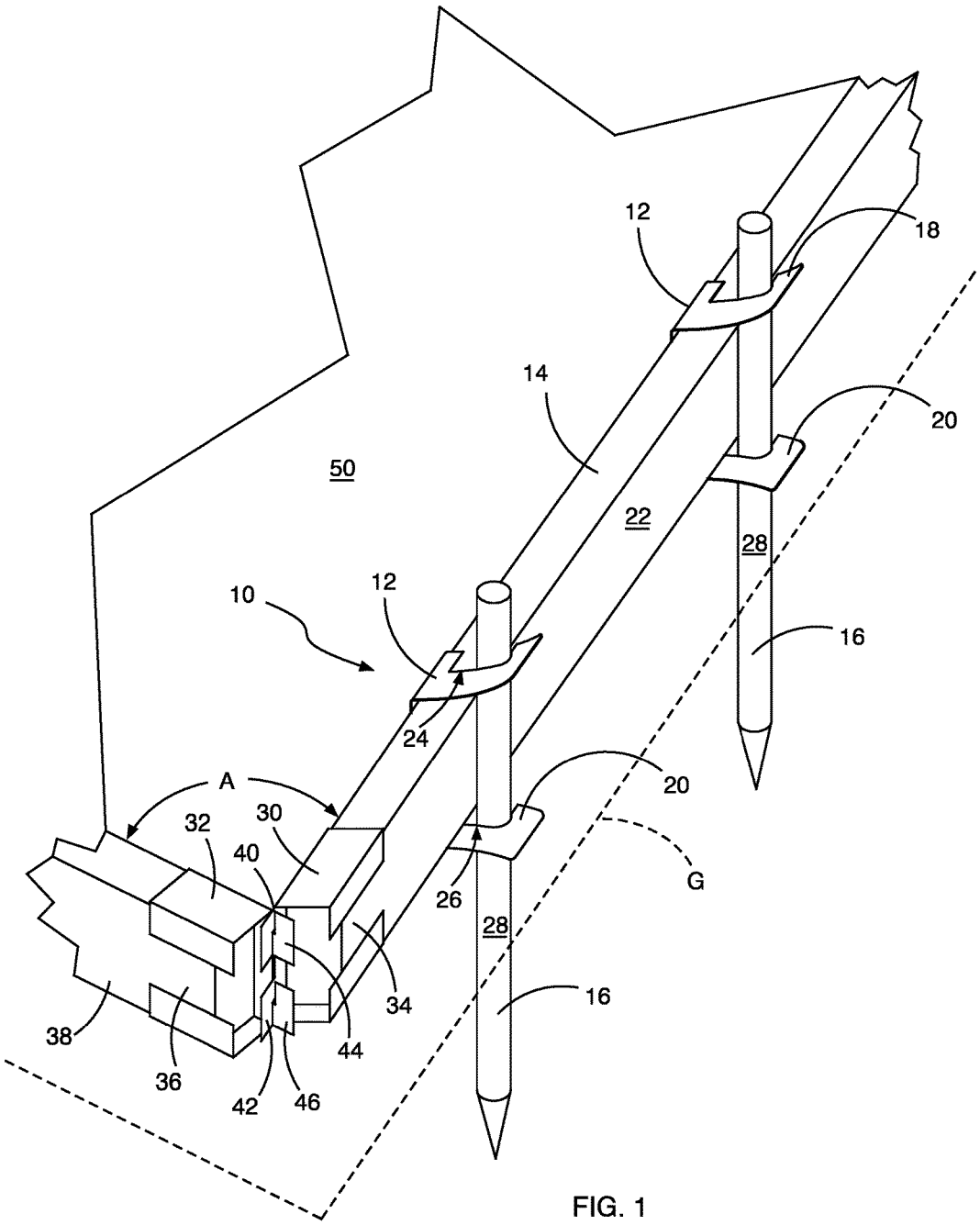
FIG. 1 is a perspective view of a first embodiment of a concrete form system in accordance with the principles of the present invention.

With reference now to the drawings in which like reference characters designate like or similar parts throughout the several views, FIG. 1 illustrates a first embodiment of a concrete form system, generally indicated at 10, in accordance with the principles of the present invention. The concrete form system 10 is comprised of a plurality of concrete form board retaining brackets 12, each configured to retain a concrete form board 14 to a respective stake 16. Each concrete form board retaining bracket 12 includes upper and lower stake retaining portions 18 and 20 that bias the stake 16 against the outer surface 22 of the concrete form board 14. The upper and lower stake retaining portions 18 and 20 define recesses 24 and 26, respectively, that engage an outer surface 28 of the stake 16 to hold the stake 16 relative to the bracket 12.

As will be described in more detail, once the stakes 16 are driven into the ground G and the form board 14 is secured to stakes 16 with brackets 12, the brackets 12 and thus the form board 14 can be vertically adjusted relative to the stake 16 without having to raise or lower the stake 16. This is accomplished by manually squeezing the end portions 18 and 20 of the bracket 12 toward each other until they are approximately parallel, which loosens the engagement of the bracket 12 with the stake 16 and allows the bracket 12 to be vertically adjusted by sliding it up or down relative to the stake 16. When the end portions 18 and 20 are released, the end portions 18 and 20 reengage with the stake to hold the bracket 12 relative to the stake 16.

A pair of substantially identical concrete form board corner brackets 30 and 32 each have a generally C-shaped configuration and are sized to slide over respective ends 34 and 36 of concrete form boards 14 and 38, respectively. The corner bracket 30 includes a pair of interlocking tabs 40 and 42 for engaging with corresponding interlocking tabs 44 and 46, respectively, of corner bracket 32. The engagement of the interlocking tabs 40 and 42 with interlocking tabs 44 and 46 connect the corner brackets 30 and 32 together in a hermaphroditic manner that allows the two corner brackets 30 and 32 to be pivotable relative to one another, thereby allowing the formation of an angle A between form board 14 and form board 38 to form a corner of concrete slab 50 having a desired angle A.

Figure 2:
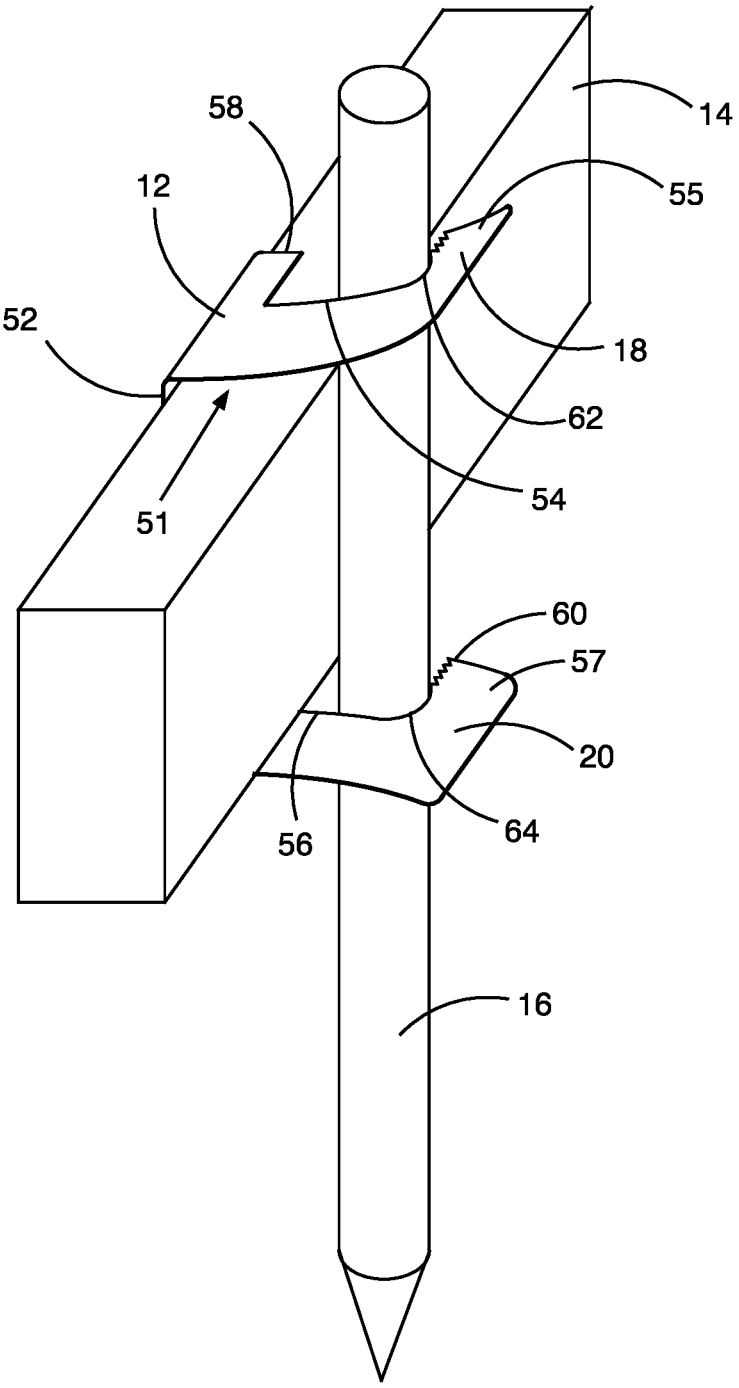
FIG. 2 is a perspective back side view of a concrete form board bracket securing a concrete form board to a stake in accordance with the principles of the present invention.
Figure 3:
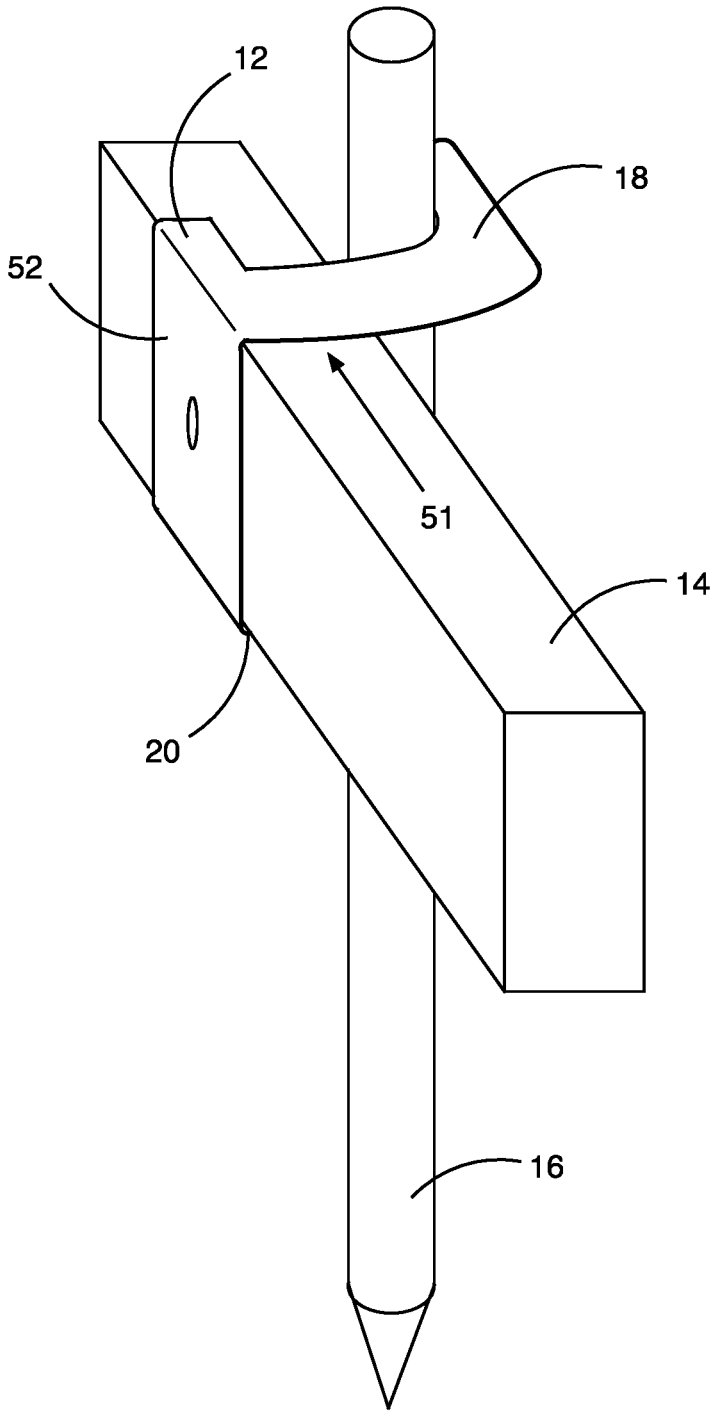
FIG. 3 is a perspective front side view of the concrete form board bracket securing the concrete form board to the stake as illustrated in FIG. 2.

As further shown in FIGS. 2 and 3, the concrete form board bracket 12 defines a generally rectangular channel 51 between the upper and lower portions 18 and 20 and the back portion 52 that is vertically sized to receive a concrete form board 14. The height of the back portion 52 is sized to be slightly larger than a particularly sized height of a concrete form board 14 so that the concrete form board 14 can be fitted within the channel 51 of the bracket 12. The upper and lower portions 18 and 20 are outwardly arched or angled relative to the back portion 52. The back portion 52 is also arched when the bracket 12 is in its free state such that when portions 18 and 20 are flexed toward one another and become substantially parallel, back portion 52 becomes straight and perpendicular to portions 18 and 20. In addition, the bracket 12 is formed from spring steel or other resilient material, such as plastic, that will allow the curved end portions 18 and 20 to be flexed toward and become substantially parallel to one another during installation, but that will try to return to their pre-flexed state when released in order to bias the stake 16 against the form board 14 when released.

As best seen in FIG. 2, the upper and lower portions 18 and 20 of the bracket 12 each have a generally J-shaped configuration that define stake-retaining recesses 54 and 56, respectively. The stake-retaining recesses 54 and 56 have a generally J-shaped configuration configured to partially wrap around the stake 16 when engaged therewith. That is the stake-retaining recesses 54 and 56 include stake-retaining portions 55 and 57, respectively, that engage a portion of the stake 16 proximate the open sides 58 and 60, respectively, of the upper and lower portions 18 and 20. The stake-retaining portions 55 and 57 define a stake receiving recess 62 and 64, respectively. To accommodate a cylindrical stake 16 as shown, the stake receiving recesses 63 and 64 have an arcuate configuration to substantially match the radius of the stake 16.

Figure 4:
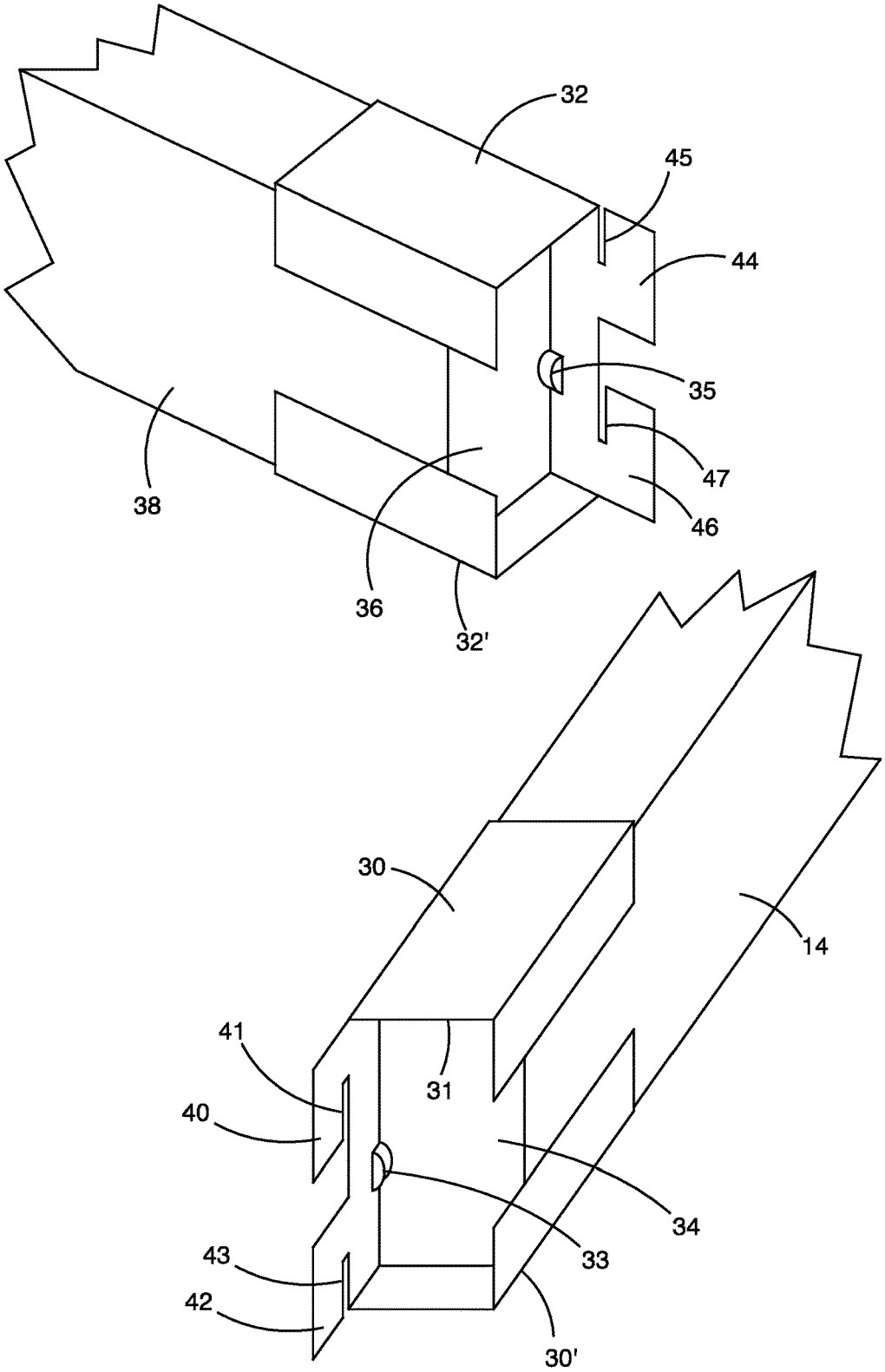
FIG. 4 is a perspective view of a first embodiment of a pair of interlocking end brackets for securing the ends of two adjacent concrete form boards in accordance with the principles of the present invention.
Figure 5:
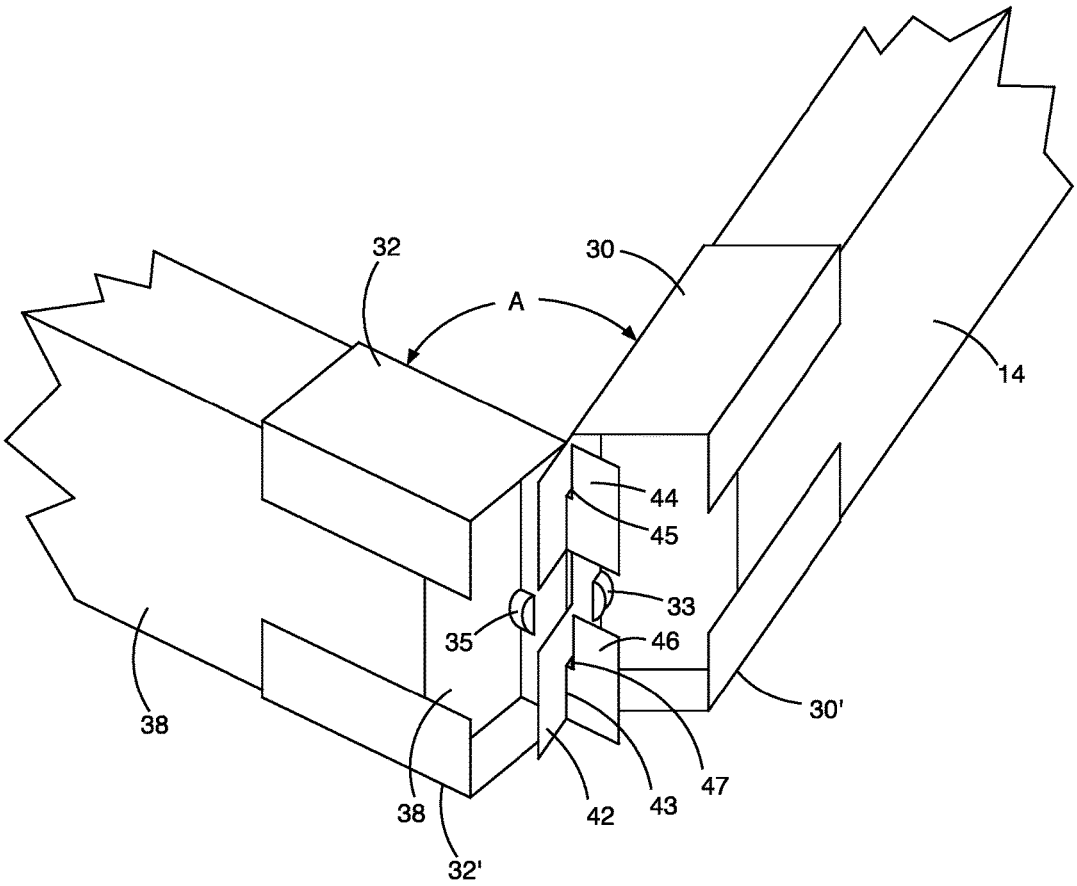
FIG. 5 is a perspective view of the pair of interlocking end brackets shown in FIG. 4 securing the ends of two adjacent concrete form boards in accordance with the principles of the present invention.
Figure 6:
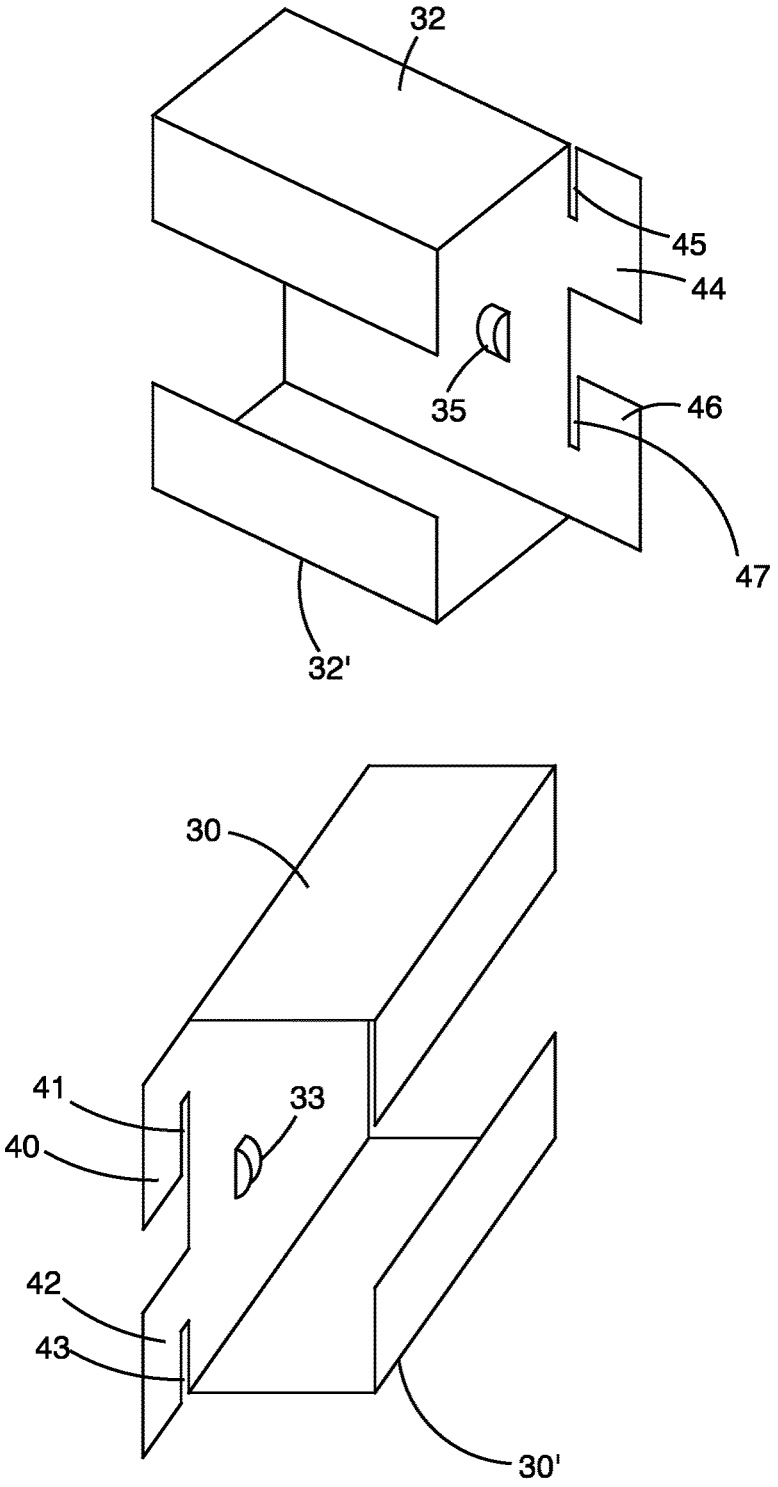
FIG. 6 is a perspective view of the pair of interlocking end brackets shown in FIG. 4.

As further illustrated in FIGS. 4, 5 and 6, the pair of concrete form board corner brackets 30 and 32 each has a generally rectangular and C-shaped configuration and is sized to slide over the respective ends 34 and 36 of concrete form boards 14 and 38, respectively. The pair of interlocking tabs 40 and 42 of corner bracket 30 are spaced from the proximal end 31 of the bracket 30 and define vertical slots 41 and 43, respectively, that vertically extend partially through the tabs 40 and 42, for engaging with corresponding slots 45 and 47 of interlocking tabs 44 and 46, respectively, of corner bracket 32. The engagement of the interlocking tabs 40 and 42 with interlocking tabs 44 and 46 connect the corner brackets 30 and 32 together, as shown in FIG. 5, in a manner that allows the two corner brackets 30 and 32 to be pivotable relative to one another, thereby allowing the formation of an angle A between form board 14 and form board 38 to form a corner of concrete slab 50 (see FIG. 1) having a desired angle A. As shown in FIGS. 4 and 5, the corner brackets 30 and 32 are slid onto the boards 14 and 38 to their relative stopping points 33 and 35 so that the body portions 30' and 32' extend beyond the ends 34 and 36 of the boards 14 and 38, respectively. This provides space for the tabs 40, 42, 44 and 46 to pivot relative to one another as the angle A is increased without the tabs 40, 42, 46 and 48 from being impeded by contacting the ends 34 and 36 of the boards 14 and 38, respectively.

Figure 7:
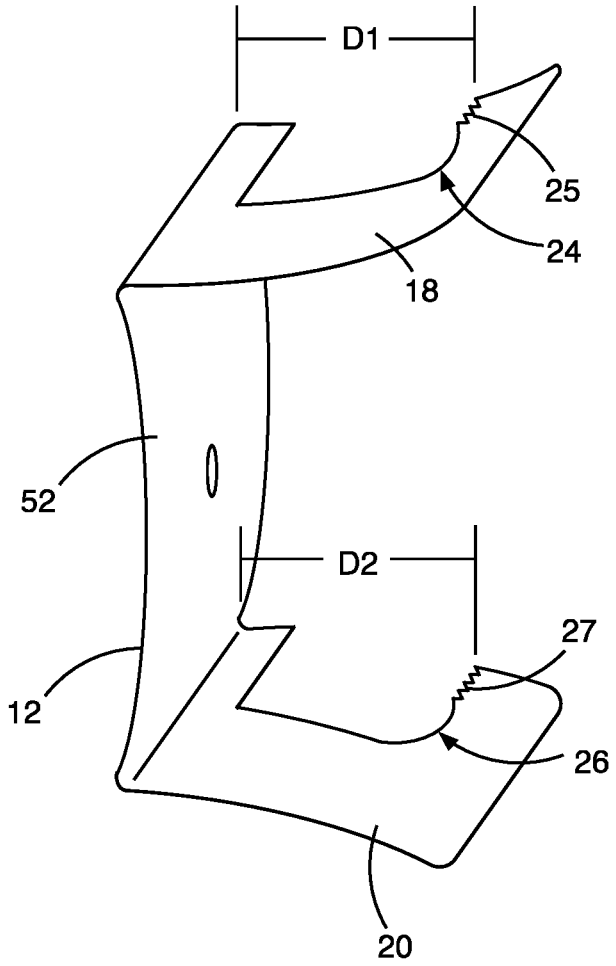
FIG. 7 is a perspective view of the concrete form bracket shown in FIG. 2.

Referring now to FIG. 7, the concrete form board retaining brackets 12 configured to retain a concrete form board to a respective stake as previously described is illustrated. Each concrete form board retaining bracket 12 includes upper and lower stake retaining portions 18 and 20 for biasing a stake against an outer surface of a concrete form board. The upper and lower stake retaining portions 18 and 20 define recesses 24 and 26 for engaging an outer surface of a stake to thereby hold the stake relative to the bracket 12. The brackets 12 are formed from spring steel or other semi-rigid, yet resilient materials, such as certain plastics. The bracket 12 shown in FIG. 7 is shown in a first resting position in that the upper and lower stake retaining portions 18 and 20 are upwardly arched relative to the back portion 52, which is also arched.

Figure 8:
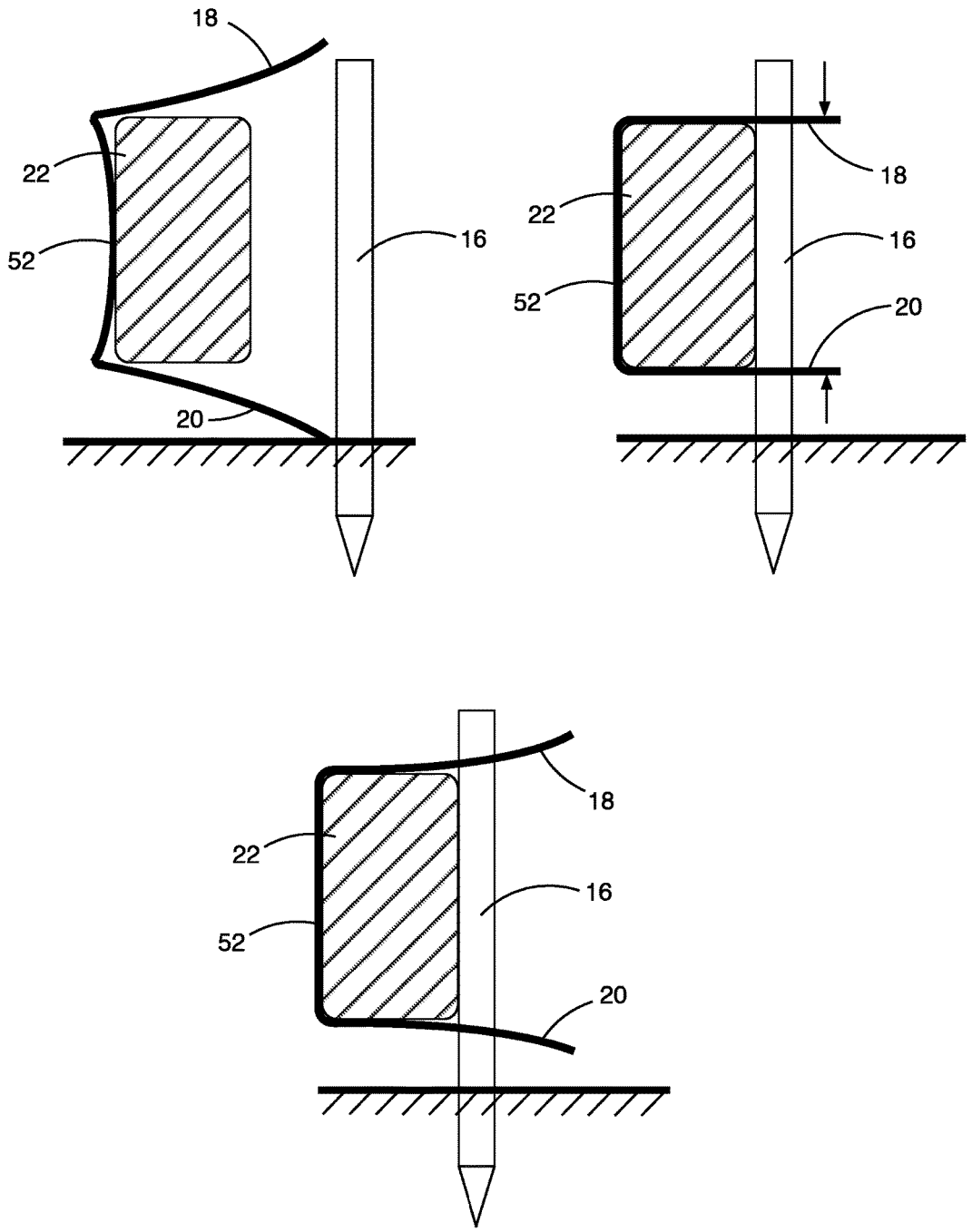
FIG. 8 are side views of the concrete form bracket shown in FIG. 7 illustrating the steps for coupling a concrete form board to a stake.

As shown in FIG. 8, the upper and lower stake retaining portions 18 and 20 can be flexed relative to one another and relative to the back portion 52 as indicated by the arrows. Flexing the upper and lower stake retaining portions 18 and 20 in this manner causes the perpendicular distances D1 and D2 (see FIG. 7) from the back portion 52 to the teeth of toothed edges 25 and 27 of the recesses 24 and 26, respectively, to increase and provide sufficient space for a stake 16 to pass between the concrete form board 22 and the edges 25 and 27. Releasing the upper and lower portions 18 and 20 allows the upper and lower portions 18 and 20 to spring back upward and downward, respectively, thereby grasping the stake 16 with the recesses 24 and 26 or the gripping teeth 25 and 27 (see FIG. 7) of round metal or wooden stakes, respectively.

Figure 9:
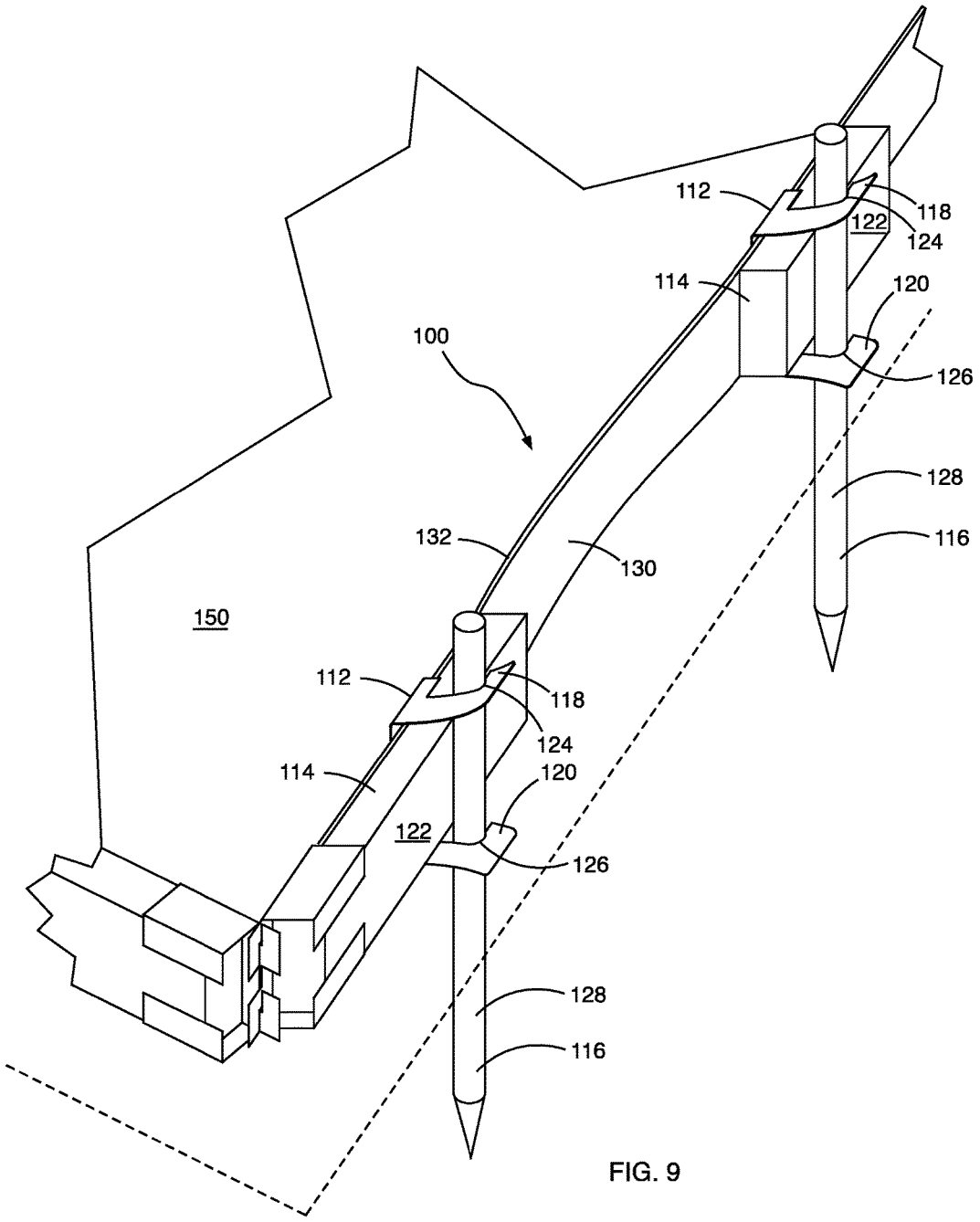
FIG. 9 is a perspective view of a second embodiment of a concrete form system in accordance with the principles of the present invention.

As shown in FIG. 9, a second embodiment of a concrete form system, generally indicated at 100, is illustrated in accordance with the principles of the present invention is illustrated. Like the concrete form system 10, the concrete form system 100 is comprised of a plurality of concrete form board retaining brackets 112, each configured to retain a concrete form board 114 to a respective stake 116. Each concrete form board-retaining bracket 112 includes upper and lower stake retaining portions 118 and 120 that bias the stakes 116 against the outer surfaces 122 of the concrete form boards 114. The upper and lower stake retaining portions 118 and 120 define recesses 124 and 126 that engage an outer surface 128 of the stake 116 to hold the stake 116 relative to the bracket 112.

Spanning between the concrete form boards 114 is a flexible concrete form member 130 that is held between the brackets 112 and the form boards 114. The flexible member 130 is formed from a thin sheet of flexible material, such as sheet metal or plastic. The flexible member 130 is thick enough, however, to hold its shape once positioned between the ground fixed stake brackets 112 so as to allow for curved edges 132 to be formed in the resulting concrete pad 150.

Figure 10:
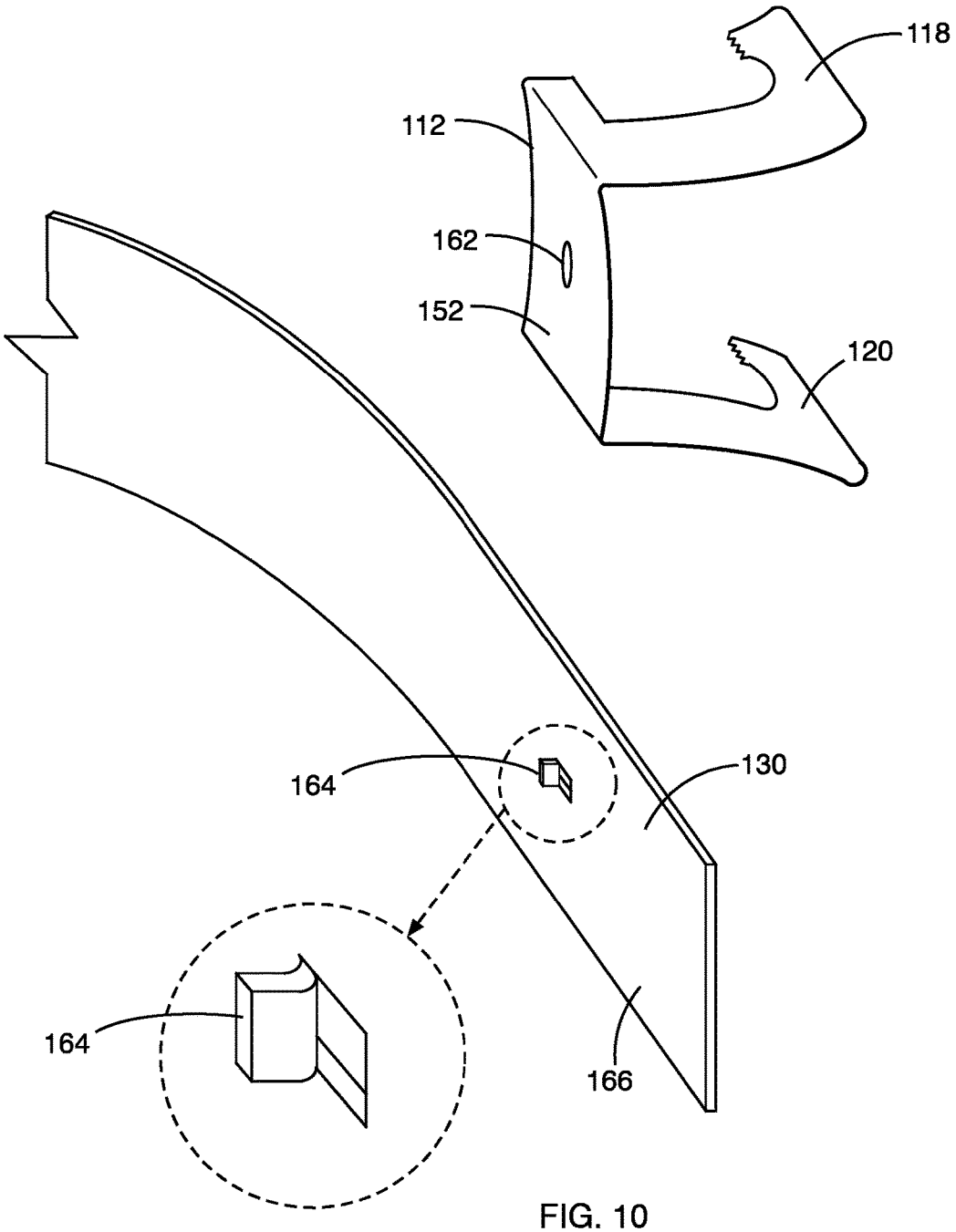
FIG. 10 is a perspective view of a concrete form bracket and a concrete form strip configured to be retained by the concrete form bracket in accordance with the principles of the present invention.
Figure 11:
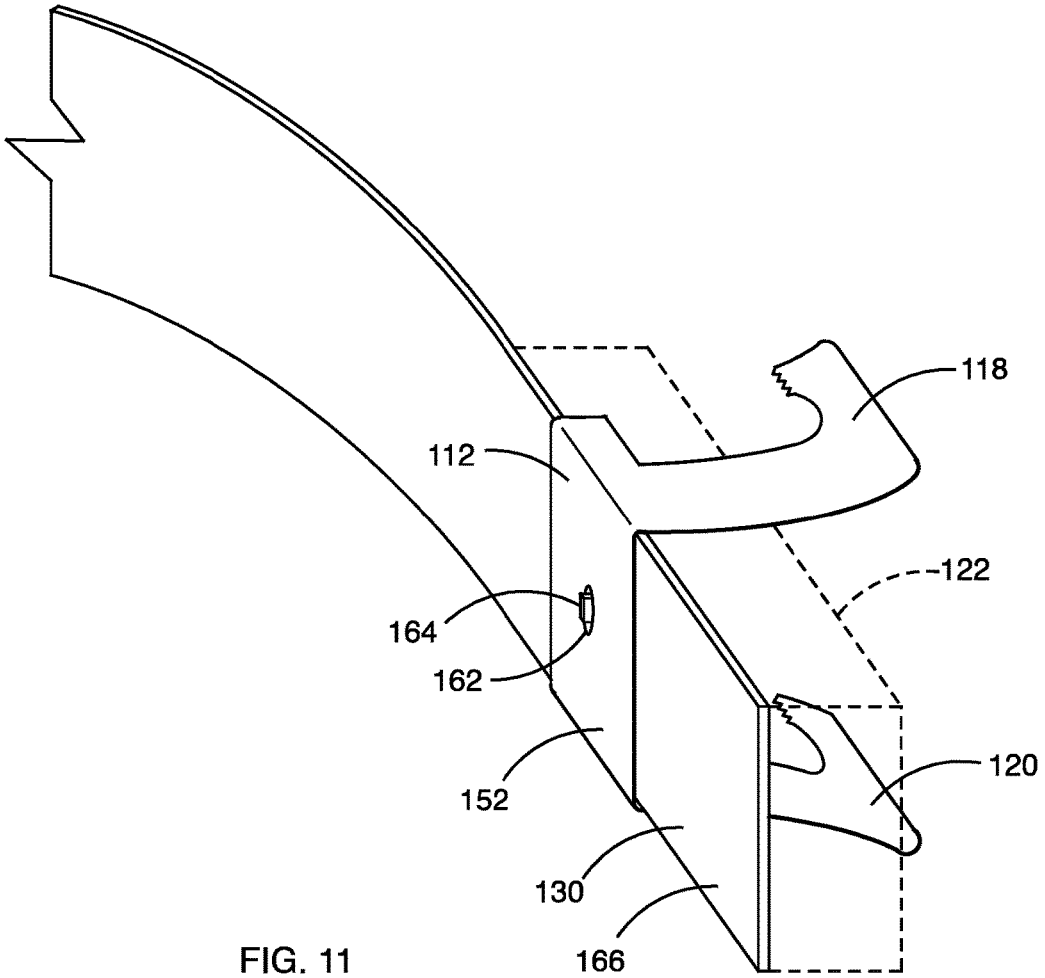
FIG. 11 is a perspective view of the concrete form bracket with the concrete form strip retained by the concrete form bracket in accordance with the principles of the present invention.

As further illustrated in FIGS. 10 and 11, the bracket 112 includes an aperture 162 in the back portion 152. The aperture 162 is sized to receive a tab 164 formed in the outer surface 166 of the flexible member 130. The tab 164 may be formed by cutting and bending a portion of the flexible member 130 or by other means known in the art, such as welding. The tab 164 is positioned to fit within the aperture 162 when the flexible member 130 is positioned against the back portion 152 between the upper and lower portions 118 and 120 in order to prevent lateral movement of the flexible member 130 relative to the bracket 112 and the form board 122 after bracket 118 is secured to the metal or wooden stake (not shown).

Figure 12:
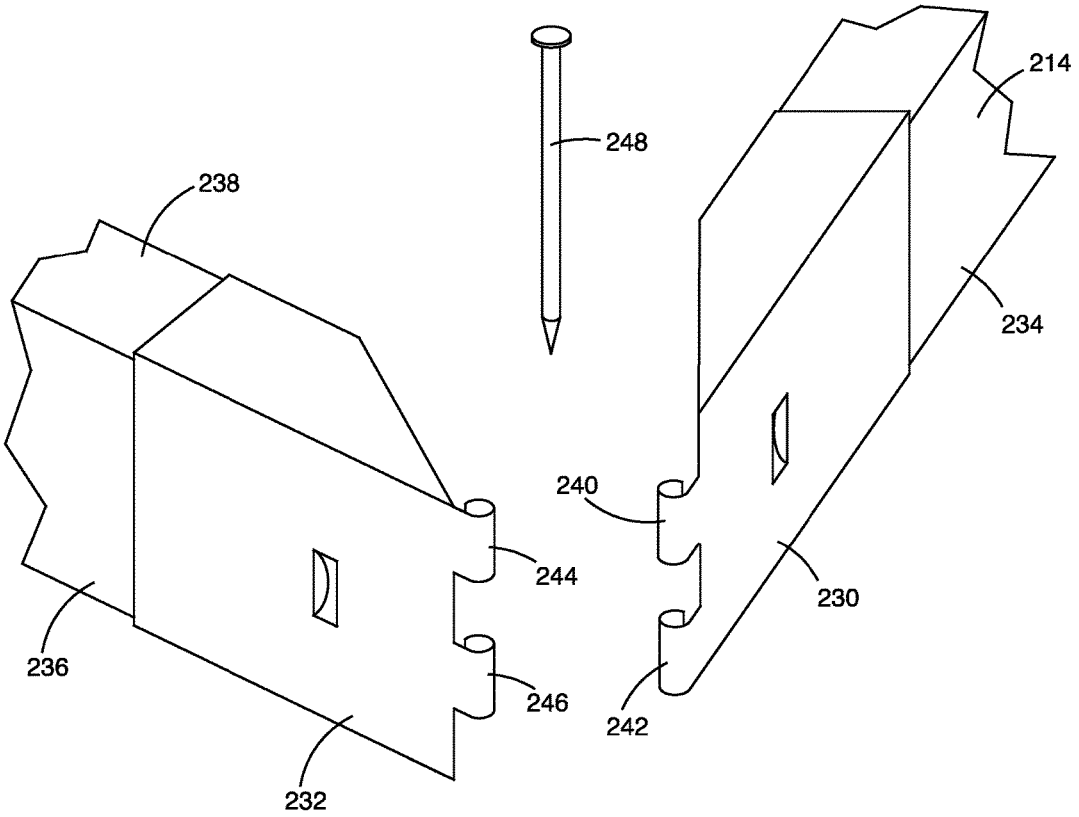
FIG. 12 is a perspective view of a second embodiment of a pair of interlocking end brackets for securing the ends of two adjacent concrete form boards in accordance with the principles of the present invention.

FIG. 12 illustrates another embodiment of a pair of concrete form board corner brackets 230 and 232 each having a generally C-shaped configuration and sized to slide over respective ends 234 and 236 of concrete form boards 214 and 238, respectively. The corner bracket 230 includes a pair of hinge members 240 and 242 for engaging with corresponding hinge members 244 and 246, respectively, of corner bracket 232. The hinge members 240 and 242 are coupled to hinge members 244 and 246 with hinge pin 248, which may be in the form of a large gauge nail. Once inserted, the hinge members 240 and 242 can pivot relative to hinge members 244 and 246 to allow the two corner brackets 230 and 232 to be pivotable relative to one another, thereby allowing the formation of an angle between form board 214 and form board 238 to form a corner of concrete slab having a desired angle.

Figure 13:
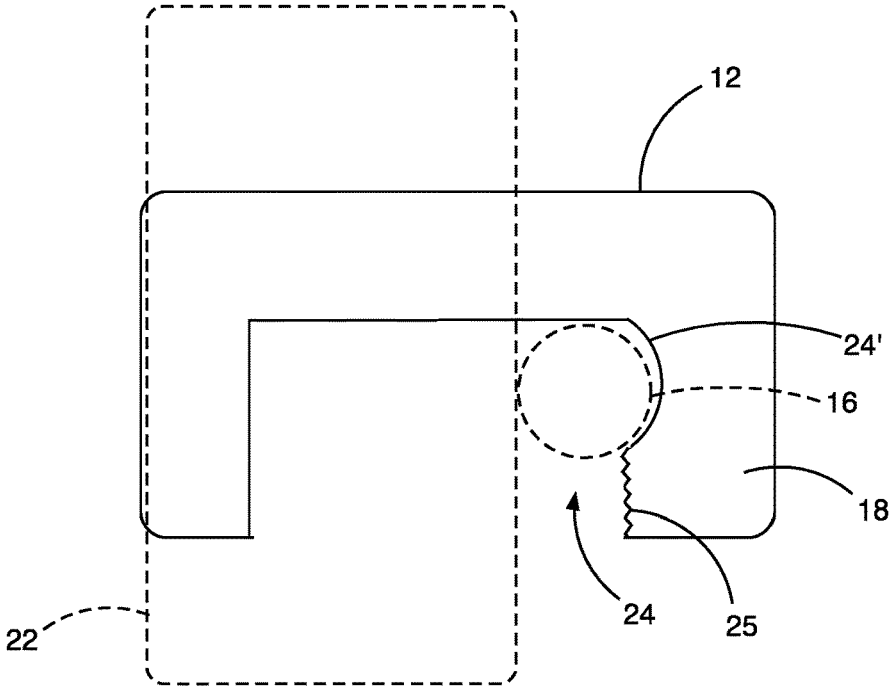
FIG. 13 is a top side view of a concrete form bracket coupled to a cylindrical stake.

As noted above, and as further illustrated in FIG. 13, the upper and lower stake retaining portions 18 and 20 of the stake retaining bracket 12 can be used with a cylindrical stake 16. When using the cylindrical stake 16, the curved stake retaining portion 24' of the recess 24 engages an outer surface of the stake 16 to bias it against form board 22.

Figure 14:
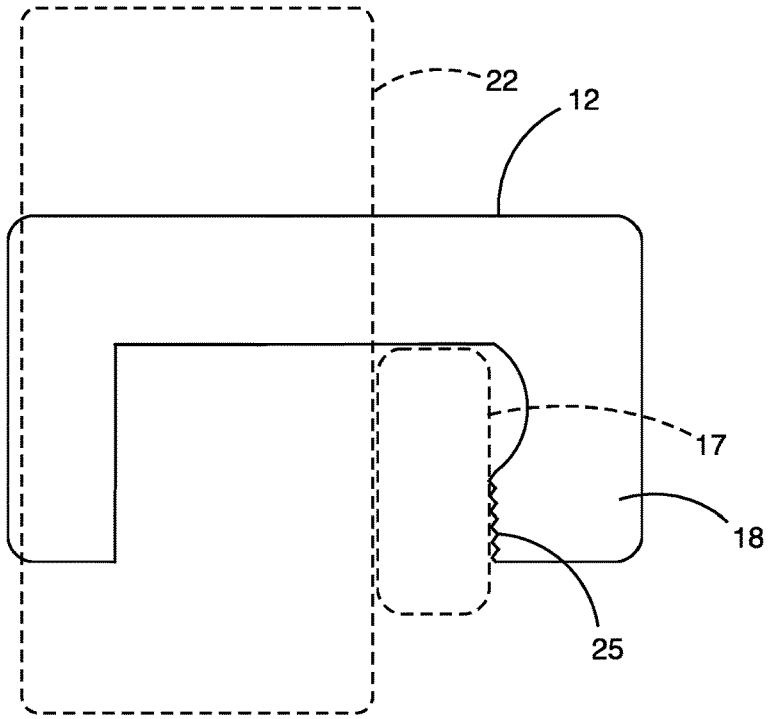
FIG. 14 is a top side view of a concrete form bracket coupled to a cylindrical stake and a rectangular stake.

As further illustrated in FIG. 14, the upper and lower stake retaining portions 18 and 20 of the stake retaining brackets 12 can alternatively be used with either a rectangular stake 17, such as a rectangular stake 17 formed from wood. When using a rectangular stake 17, the teeth of toothed edge 25 of the stake retaining portion 18 engages an outer surface of the stake 17 to bias it against form board 22.

It is contemplated, and will be apparent to those skilled in the art from the foregoing specification, drawings, and examples that modifications and/or changes may be made in the embodiments of the invention. Accordingly, it is expressly intended that the foregoing are only illustrative of certain embodiments and modes of operation, not limiting thereto, and that the true spirit and scope of the present invention be determined by reference to the appended claims.

While the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

Thus, aspects and applications of the invention presented here are described in the drawings and in the foregoing detailed description of the invention. Those of ordinary skill in the art will realize that the description of the present invention is illustrative only and not in any way limiting. Other embodiments of the invention will readily suggest themselves to such skilled persons including, without limitation, combinations of elements of the various embodiments. Various representative implementations of the present invention may be applied to any tie down cargo restraining system.

Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use the plain and ordinary meaning of terms in the specification and claims unless they clearly state otherwise in which case, the inventor will set forth the "special" definition of that term and explain how it differs from the plain and ordinary meaning. Absent such statements of the application of a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f) to define the invention. To the contrary, if the provisions of 35 U.S.C. § 112(f) are sought to be invoked to define the inventions, the claims will specifically and expressly state the exact phrases "means for" or "step for" and the specific function (e.g., "means for heating"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

What is claimed is:

1. A concrete form system, comprising:

a plurality of concrete form board retaining brackets, each comprising a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction;

a plurality of concrete form stakes; and at least one concrete form board, each of the plurality of concrete form board retaining brackets configured to retain the at least one concrete form board to a respective one of the plurality of concrete form stakes, each concrete form board retaining bracket having an upper and lower stake retaining portion that bias the respective concrete form stake against an outer surface of the at least one concrete form board, the upper and lower stake retaining portions each defining a recess that engages an outer surface of the concrete form stake to hold the stake relative to the bracket, wherein a distance between the first wall and the second wall at the back wall of each of the plurality of concrete form board retaining brackets is configured to be approximately equal to a width of a concrete form board when the concrete form board is abutted against the front side of the back wall.

2. The concrete form system of claim 1, wherein the upper wall extends upwardly and away from a top surface of the concrete form board when in a resting position of the concrete form bracket and wherein the lower wall extends downwardly and away from a bottom surface of the concrete form board when in the resting position.

3. The concrete form system of claim 2, wherein the upper stake retaining portion is comprised of a first recess having a first stake receiving opening along a portion of a first side of the upper wall and a first stake retaining portion configured to retain a first portion of an elongate concrete form stake therein.

4. The concrete form system of claim 3, wherein the lower stake retaining portion is comprised of a second recess having a second stake receiving opening along a portion of a first side of the upper wall and a second stake retaining portion configured to retain a second portion of the elongate concrete form stake therein when the respective one of the plurality of concrete form stakes extends through the first recess and the second recess.

5. The concrete form system of claim 1, wherein the upper wall and lower wall are compressible toward one another when the upper wall is forced toward the lower wall and the back wall is abutting against a concrete form board positioned between the upper wall and lower wall to allow the respective one of the plurality of concrete form stakes to be positioned between the at least one concrete form board and outermost edges of the upper and lower stake retaining portions.

6. The concrete form system of claim 1, wherein the upper and lower stake retaining portions are biased away from one another to hold the respective one of the plurality of concrete form stakes against a surface of the concrete form board.

7. The concrete form system of claim 1, further comprising at least one pair of concrete form board end joining brackets, each configured to extend over a respective end of adjacent concrete form boards and interlock in a hermaphroditic manner.

8. The concrete form system of claim 7, wherein the at least one pair of concrete form board end joining brackets form a hinge to allow the adjacent concrete form boards to pivot relative to one another until held in position with the plurality of concrete form retaining brackets.

9. The concrete form system of claim 8, wherein each concrete form board end joining bracket wraps at least partially around the respective end of the concrete form board and comprise a stop positioned adjacent the respective end of the concrete form board to position the respective concrete form board relative to the respective concrete form board end joining bracket.

10. The concrete form system of claim 1, wherein the at least one concrete form board is comprised of a curved form coupled to and between the plurality of concrete form board retaining brackets.

11. The concrete form system of claim 1, wherein the back wall of a respective one of the plurality of concrete form board retaining brackets defines an aperture and wherein the at least one concrete form board comprises a bracket retaining member extending therefrom, the bracket retaining member received within the aperture to position the at least one concrete form board relative to the respective one of the plurality of concrete form board retaining brackets.

12. The concrete form system of claim 1, wherein the upper wall, lower wall and back wall of each of the plurality of concrete form brackets are each inwardly curved in a resting position.

13. A concrete form bracket, comprising:

a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction, the upper wall, lower wall and back wall each inwardly curved in a resting position, wherein a distance between the first wall and the second wall at the back wall is configured to be approximately equal to a width of a concrete form board when the concrete form board is abutted against the front side of the back a wherein the upper wall extends upwardly and away from a top surface of the concrete form board when in a resting position of the concrete form bracket and wherein the lower wall extends downwardly and away from a bottom surface of the concrete form board when in the resting position;

the upper wall defining a first recess having a first stake receiving opening along a portion of a first side of the upper wall and a first stake retaining portion configured to retain a first portion of an elongate concrete form stake therein;

the lower wall defining a second recess having a second stake receiving opening along a portion of a first side of the upper wall and a second stake retaining portion configured to retain a second portion of the elongate concrete form stake therein when the elongate concrete form stake extends through the first recess and the second recess;

the upper wall and lower wall being compressible toward one another when the upper wall is forced toward the lower wall and the back wall is abutting against a concrete form board positioned between the upper wall and lower wall to allow the stake to be positioned between the concrete form board and outermost edges of the first and second recesses; and the upper and lower walls being biased away from one another when not being compressed toward one another to hold the stake against a surface of the concrete form board.

14. The concrete form bracket of claim 13, wherein the first stake retaining portion defines a first curved recess for abutting against and receiving a first portion of the stake therein and wherein the second stake retaining portion defines a second curved recess for abutting against and receiving a second portion of the stake therein.

15. The concrete form bracket of claim 13, wherein the first stake retaining portion defines a first plurality of teeth for engaging with and retaining a first portion of the stake and wherein the second stake retaining portion defines a second plurality of teeth for engaging with and retaining a second portion of the stake.

16. The concrete form bracket of claim 13, wherein the back wall defines an aperture configured to receive a concrete form board retaining member of a concrete form board.

17. A concrete form system, comprising:

a plurality of concrete form board retaining brackets, each comprising a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction;

a plurality of concrete form stakes; and at least one concrete form board, each of the plurality of concrete form board retaining brackets configured to retain the at least one concrete form board to a respective one of the plurality of concrete form stakes, each concrete form board retaining bracket having an upper and lower stake retaining portion that bias the respective concrete form stake against an outer surface of the at least one concrete form board, the upper and lower stake retaining portions each defining a recess that engages an outer surface of the concrete form stake to hold the stake relative to the bracket, wherein the upper wall and lower wall are compressible toward one another when the upper wall is forced toward the lower wall and the back wall is abutting against a concrete form board positioned between the upper wall and lower wall to allow the respective one of the plurality of concrete form stakes to be positioned between the at least one concrete form board and outermost edges of the upper and lower stake retaining portions.

18. The concrete form system of claim 17, wherein a distance between the first wall and the second wall at the back wall is configured to be approximately equal to a width of a concrete form board when the concrete form board is abutted against the front side of the back wall.

19. The concrete form system of claim 18, wherein the upper wall extends upwardly and away from a top surface of the concrete form board when in a resting position of the concrete form bracket and wherein the lower all extends downwardly and away from a bottom surface of the concrete form board when in the resting position.

20. The concrete form system of claim 19, wherein the upper stake retaining portion is comprised of a first recess having a first stake receiving opening along a portion of a first side of the upper wall and a first stake retaining portion configured to retain a first portion of an elongate concrete form stake therein.

21. A concrete form system, comprising:

a plurality of concrete form board retaining brackets, each comprising a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction;

a plurality of concrete form stakes; and at least one concrete form board, each of the plurality of concrete form board retaining brackets configured to retain the at least one concrete form board to a respective one of the plurality of concrete form stakes, each concrete form board retaining bracket having an upper and lower stake retaining portion that bias the respective concrete form stake against an outer surface of the at least one concrete form board, the upper and lower stake retaining portions each defining a recess that engages an outer surface of the concrete form stake to hold the stake relative to the bracket, wherein the back wall of a respective one of the plurality of concrete form board retaining brackets defines an aperture and wherein the at least one concrete form board comprises a bracket retaining member extending therefrom, the bracket retaining member received within the aperture to position the at least one concrete form board relative to the respective one of the plurality of concrete form board retaining brackets.

22. The concrete form system of claim 21, wherein a distance between the first wall and the second wall at the back wall is configured to be approximately equal to a width of a concrete form board when the concrete form board is abutted against the front side of the back wall.

23. The concrete form system of claim 22, wherein the upper wall extends upwardly and away from a top surface of the concrete form board when in a resting position of the concrete form bracket and wherein the lower wall extends downwardly and away from a bottom surface of the concrete form board when in the resting position.

24. The concrete form system of claim 23, wherein the upper stake retaining portion is comprised of a first recess having a first stake receiving opening along a portion of a first side of the upper wall and a first stake retaining portion configured to retain a first portion of an elongate concrete form stake therein.

25. A concrete form system, comprising:

a plurality of concrete form board retaining brackets, each comprising a generally rectangular plate having a back wall, an upper wall depending from a top edge of the back wall at a first obtuse angle from the back wall and a lower wall depending from a bottom edge of the back wall at a second obtuse angle from the back wall, the top and bottom walls depending from a front side of the back wall so as to extend from the back wall in generally a same direction, the upper wall, lower wall and back wall of each of the plurality of concrete form brackets are each inwardly curved in a resting position;

a plurality of concrete form stakes; and at least one concrete form board, each of the plurality of concrete form board retaining brackets configured to retain the at least one concrete form board to a respective one of the plurality of concrete form stakes, each concrete form board retaining bracket having an upper and lower stake retaining portion that bias the respective concrete form stake against an outer surface of the at least one concrete form board, the upper and lower stake retaining portions each defining a recess that engages an outer surface of the concrete form stake to hold the stake relative to the bracket, wherein a distance between the first wall and the second wall at the back wall of each of the plurality of concrete form board retaining brackets is configured to be approximately equal to a width of a concrete form board when the concrete form board is abutted against the front side of the back wall.

26. The concrete form system of claim 25, wherein a distance between the first wall and the second wall at the back wall is configured to be approximately equal to a width of a concrete form board when the concrete form board is abutted against the front side of the back wall.

27. The concrete form system of claim 26, wherein the upper wall extends upwardly and away from a top surface of the concrete form board when in a resting position of the concrete form bracket and wherein the lower wall extends downwardly and away from a bottom surface of the concrete form board when in the resting position.

28. The concrete form system of claim 27, wherein the upper stake retaining portion is comprised of a first recess having a first stake receiving opening along a portion of a first side of the upper wall and a first stake retaining portion configured to retain a first portion of an elongate concrete form stake therein.

* * * * *